US010914105B2

(12) United States Patent
Ridilla

(10) Patent No.: US 10,914,105 B2
(45) Date of Patent: Feb. 9, 2021

(54) CABINET DOOR ASSEMBLY FOR A HOUSEHOLD APPLIANCE

(71) Applicant: WHIRLPOOL CORPORATION, Benton Harbor, MI (US)

(72) Inventor: Jaroslav Ridilla, Poprad (SK)

(73) Assignee: Whirlpool Corporation, Benton Harbor, MI (US)

( * ) Notice: Subject to any disclaimer, the term of this patent is extended or adjusted under 35 U.S.C. 154(b) by 360 days.

(21) Appl. No.: 15/968,088

(22) Filed: May 1, 2018

(65) Prior Publication Data

US 2019/0338574 A1 Nov. 7, 2019

(51) Int. Cl.
*E05D 7/04* (2006.01)

(52) U.S. Cl.
CPC ..... *E05D 7/04* (2013.01); *E05Y 2900/30* (2013.01)

(58) Field of Classification Search
CPC ..... E05D 7/009; E05D 2007/0469
See application file for complete search history.

(56) References Cited

U.S. PATENT DOCUMENTS 2,725,589 A * 12/1955 Papesh ..... E05D 5/023 16/236
5,133,109 A * 7/1992 Mariani ..... E05D 7/0407 16/238
5,339,493 A * 8/1994 MacIntyre ..... E05D 7/0423 16/238
5,920,958 A * 7/1999 Domenig ..... E05D 7/0423 16/237
8,413,299 B2 * 4/2013 Bartels ..... E05D 7/0423 16/236
9,416,573 B2 * 8/2016 Sabrowski ..... E05D 7/0415
10,273,730 B2 * 4/2019 Liermann ..... E05D 7/0415
10,704,218 B2 * 7/2020 Assinck ..... E05D 3/18
2005/0183238 A1 * 8/2005 McCue ..... E05D 7/0027 16/236
2012/0286632 A1 11/2012 Wilson et al.

FOREIGN PATENT DOCUMENTS

DE 102008016929 B3 5/2009
EP 0046314 A1 2/1982
EP 0413396 A1 2/1991
EP 1496181 A1 * 1/2005 ..... E05D 7/04
EP 2108729 A1 10/2009
ES 1064166 U 2/2007
GB 2114432 A 8/1983
GB 2322908 A 9/1998
(Continued)

OTHER PUBLICATIONS

East Coast Kitchen; easy fit appliance door hinge available at https://www.ebay.co.uk/itm/Easy-Fit-Hinge-For-Free-Stood-Appliances-Enable-Integrated-Look-Fridge-Freezers-/251339063065, accessed Mar. 20, 2018.
(Continued)

*Primary Examiner* — Catherine A Kelly
(74) *Attorney, Agent, or Firm* — McGarry Bair PC

(57) ABSTRACT

A cabinet door assembly for a household appliance that couples a cabinet door to the household appliance. The cabinet door assembly can include a cabinet door and hinge assembly. The hinge assembly can include one or more braces that secure to the cabinet door and repositionable hinges.

19 Claims, 8 Drawing Sheets

(56) References Cited

FOREIGN PATENT DOCUMENTS

WO 2017133782 A1 8/2017

OTHER PUBLICATIONS

Kyprianos Aluminum T-slot; Part #3030 Profile hinge 30×30 + screws+ T-nut, 4 sets available at https://www.ebay.co.uk/itm/Aluminum-T-slot-3030-profile-hinge-30×30-screw-T-nuts-4-set-/262577653904, accessed Mar. 20, 2018.
IKEA; sliding hinge available at https://www.ebay.co.uk/itm/sliding-hinge-IKEA-Behjalplig-/253429114736, accessed Mar. 20, 2018.
European Search Report for Counterpart EP18215566.3, dated Mar. 29, 2019.

* cited by examiner

CABINET DOOR ASSEMBLY FOR A HOUSEHOLD APPLIANCE

BACKGROUND

Household appliances can be built-in or integrated into household cabinetry, be it pre-assembled or ready-to-assembly cabinetry, such that the appliance appears to be part of the cabinetry. Built-in or integrated household appliances are often manufactured with predetermined locations for hinges used to attach an existing cabinet door to the front of the household appliance. However, the predetermined location for mounting hinges to the built-in or integrated household appliance often does not line up with the hinge location of the existing cabinet door for a few reasons. The household appliances typically have a shorter height than the cabinetry and a toe-kick area, resulting in the appliance not having structure adjacent the more typical locations for the cabinet door hinge. The household appliance typically does not have the same perfectly rectangular shape and planar front found on cabinetry. The hinge type and hinge location on cabinet doors, especially for ready-to-assemble cabinetry is not standardized, resulting in manufacturer-specific milling/drilling for the hinges. Thus, the existing cabinet door must then be modified by milling or drilling so that hinges can be mounted on the existing door in new locations that aligns with the predetermined locations for mounting hinges to the built-in or integrated household appliance.

SUMMARY

In one aspect of the present disclosure, a household appliance includes at least one predetermined first hinge mount. A cabinet door assembly for the household appliance includes a cabinet door that has at least one predetermined second hinge mount that is out of registry with a corresponding first hinge mount. The cabinet door assembly also includes a brace having a first attachment secured to the cabinet door at a first location other than the second hinge mount, a second attachment secured to the cabinet door at the second hinge mount, and a rail. The cabinet door assembly further includes a hinge having a first hinge plate repositionably secured to the rail and a second hinge plate securable to the first hinge mount.

In another aspect of the present disclosure, a hinge assembly can securing a first hinge mount of a household appliance to an out of registry second hinge mount of a cabinet door. The hinge assembly includes a brace having a first attachment secured to the cabinet door at a first location other than the second hinge mount, a second attachment secured to the cabinet door at the second hinge mount, and a rail. The hinge assembly also includes a hinge having a first hinge plate repositionably secured to the rail and a second hinge plate securable to the first hinge mount.

Yet another aspect of the present disclosure includes a method for mounting a hinge with first and second hinge plates to a household appliance where a first hinge mount to a cabinet door with a second hinge mount is out of registry with the first hinge mount. The method includes securing a brace with a rail to the second hinge mount. The first hinge plate is slidably secured to the rail such that the second hinge plate is in registry with the first hinge mount. The second hinge plate is secured to the first hinge mount.

DESCRIPTION

Figure 1:
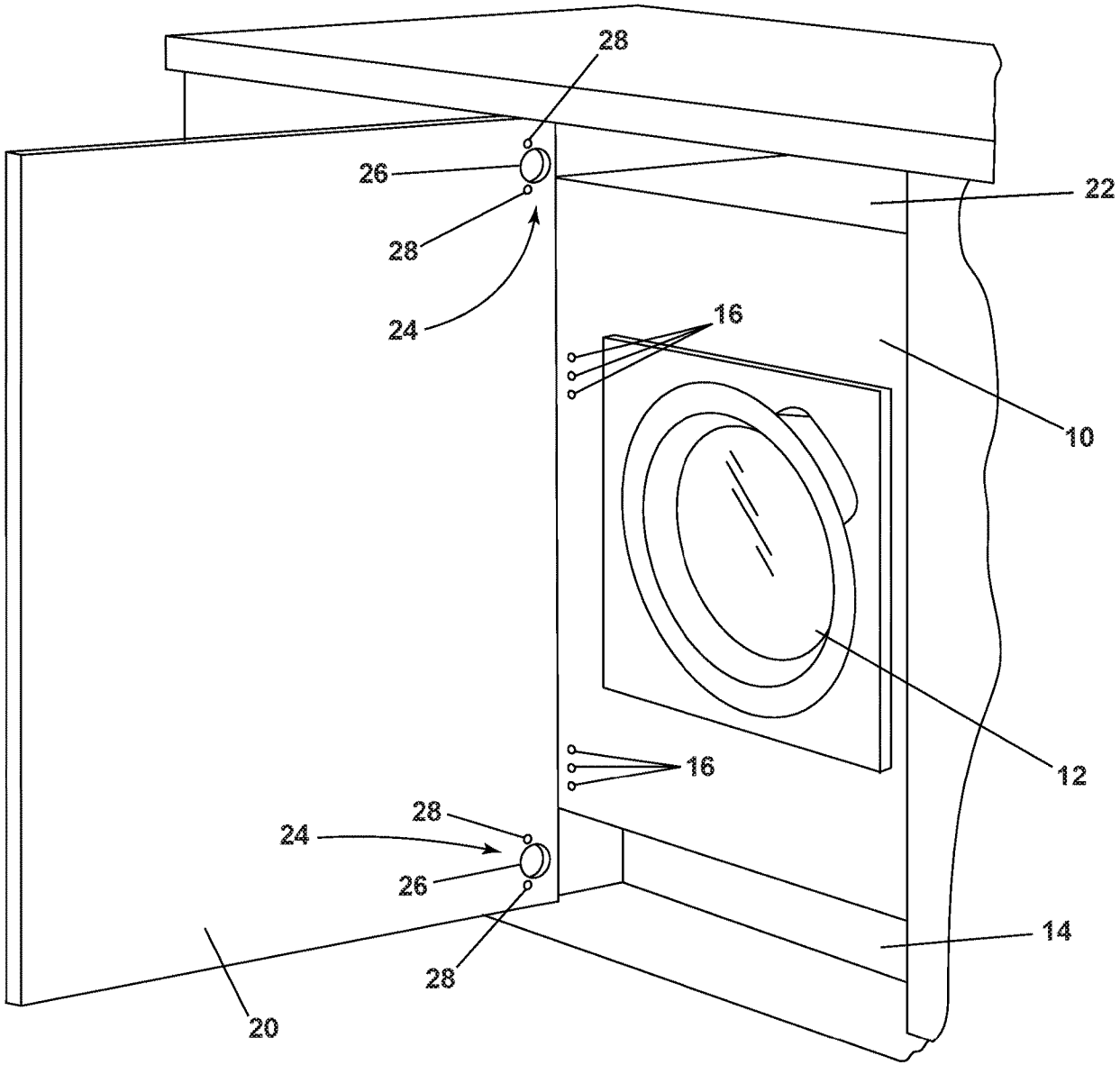
FIG. 1 is a perspective view of a built-in household appliance and a surrounding cabinetry without a hinge assembly connecting a cabinet door to the household appliance.

To attach a cabinet door to a household appliance in which predetermined hinge mounts of the cabinet door and the household appliance do not align; a mounting assembly can be used to prevent the user from having to mill, drill, or otherwise permanently modify the cabinet door. The mounting assembly can be a hinge assembly for hingedly securing the cabinet door to the appliance. The hinge assembly can include a variable position hinge that provides adjustability to accommodate different hinge locations on the cabinet door as well as the appliance.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, secured, fastened, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

FIG. 1 illustrates a household appliance 10 with a built-in design, where cabinetry, walls, paneling, or furniture encompasses one or more sides of the household appliance 10. In non-limiting examples, the household appliance 10 can replace an existing cabinet or fill an intentional void between cabinets. The household appliance 10 is illustrated in FIG. 1 using a schematic representation having a shape that is predominantly a combination of rectangular prisms. The schematic representation of the household appliance 10 is a non-limiting example, as the household appliance 10 can vary in size and shape.

The household appliance 10 includes an appliance door 12, also schematically shown in FIG. 1. The appliance door 12 can be one or more appliance doors of varying size and shape that provide access for a user to the household appliance 10. Optionally, the household appliance 10 can have a toe-kick 14, which is a recessed area at the bottom of the household appliance in which the feet/toes of a user can be received when standing in front of the household appliance 10.

The household appliance 10 has one or more predetermined first hinge mounts 16. The first hinge mounts 16 can be located on the left side, right side, or both sides of the household appliance 10. The first hinge mounts 16 can be provided by the manufacturer of the household appliance 10. The intended use of the first hinge mounts 16 is to assist in the mounting of a cabinet door 20 to the household appliance 10.

The cabinet door 20 can be for a standard height cabinet. The standard height cabinet can be, but is not limited to, 35 inches, which is an industry standard for kitchen cabinets. The cabinet door 20 can be taller than the household appliance 10.

The cabinet door 20 can include one or more second hinge mounts 24. Each second hinge mount 24 includes a hinge recess 26 and second apertures 28. The second hinge mounts 24 of the cabinet door 20 can be out of registry with the first hinge mounts 16 of the household appliance 10.

One or more corresponding pairs of first and second hinge mounts 16, 24 can be out of registry. A non-limiting example of how the second hinge mounts 24 of the cabinet door 20 can be out of registry with one or more of the first hinge mounts 16 occurs when one or more of the second hinge mounts 24 are located at least in part above a top 22 of household appliance 10. Alternatively or additionally, in another non-limiting example, one or more of the second hinge mounts 24 of the cabinet door 20 can be out of registry with one or more of the first hinge mounts 16 if at least a portion of the second hinge mount 24 overlaps the toe-kick 14 of the household appliance 10.

The second hinge mounts 24 are illustrated as vertically out of registry with the first hinge mounts 16, but the misalignment can be a result of locations being out of registry in a vertical and/or horizontal direction.

Figure 2:
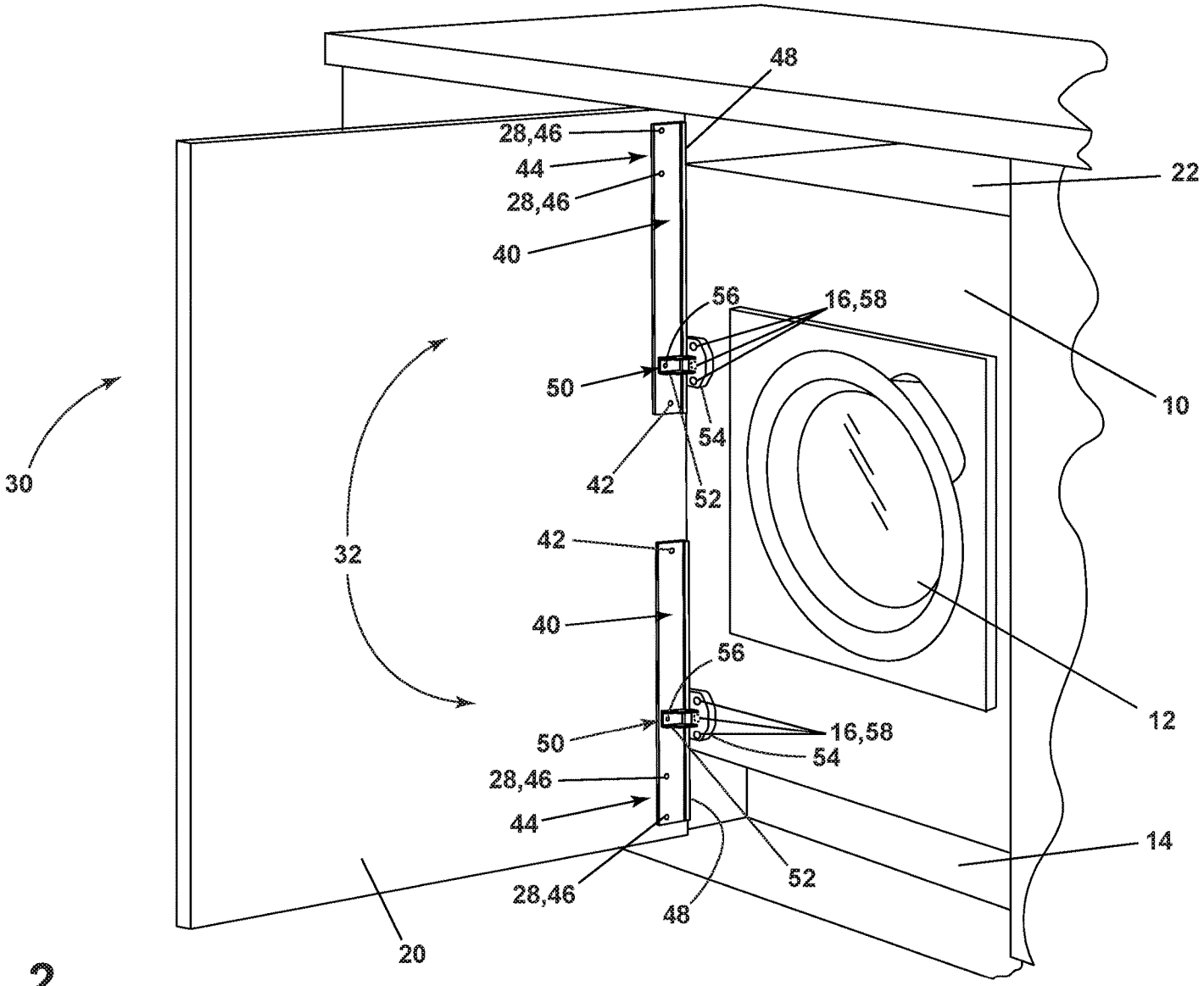
FIG. 2 is a perspective view of the built-in household appliance and the surrounding cabinetry with a hinge assembly connecting the cabinet door to the household appliance.

FIG. 2 illustrates a pair of vertically-spaced hinge assemblies 32 used to couple the cabinet door 20 to the household appliance 10. Each hinge assembly 32 includes a brace 40 and a hinge 50. The hinge assembly 32 in combination with the cabinet door 20 forms a cabinet door assembly 30.

The brace 40 is secured to the cabinet door 20 at a first attachment point 42 and a second attachment point 44. The second attachment point 44 is illustrated with first apertures 46 that corresponds to second apertures 28. The brace 40 also includes a rail 48. The brace 40 can be elongated to extend along the cabinet door 20 from the second hinge mount 24 to below the first hinge mount 16.

The hinge 50 has a first hinge plate 52 and a second hinge plate 54. The first hinge plate 52 is repositionally secured to the rail 48. The first hinge plate 52 can be slidably coupled to the rail 48. The first hinge plate 52 can be fixedly connected to the brace 40 by a first fixing point 56. The second hinge plate 54 can be secured to the household appliance 10 by a second fixing point 58 at the first hinge mount 16.

Figure 3:
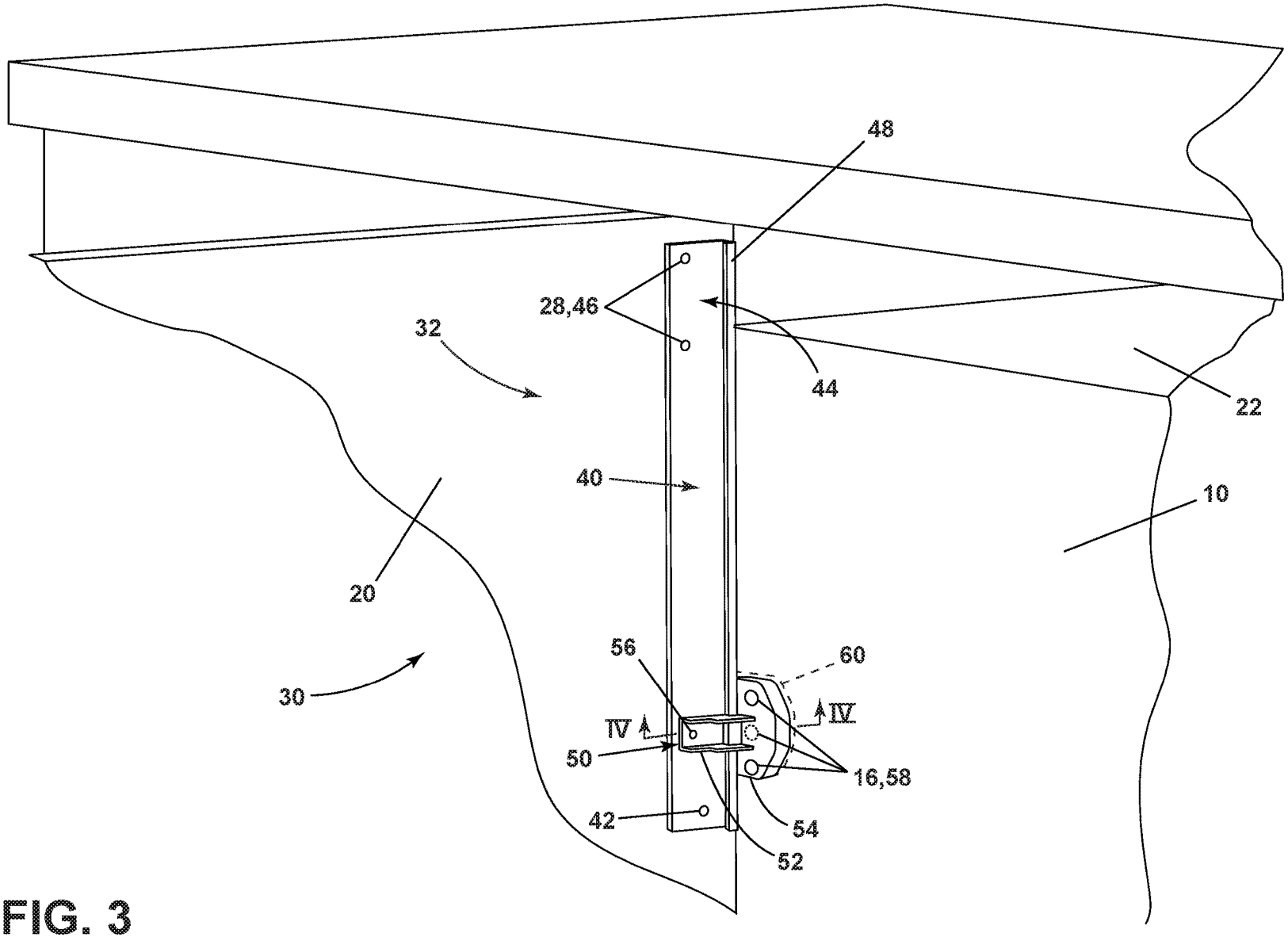
FIG. 3 is an enlarged view of the hinge assembly from FIG. 2.

FIG. 3 is an enlarged view of the brace 40 and hinge 50 of the hinge assembly 32 from FIG. 2. An optional spacer 60 can be placed between the second hinge plate 54 and the first hinge mount 16 of the household appliance 10.

Figure 4:
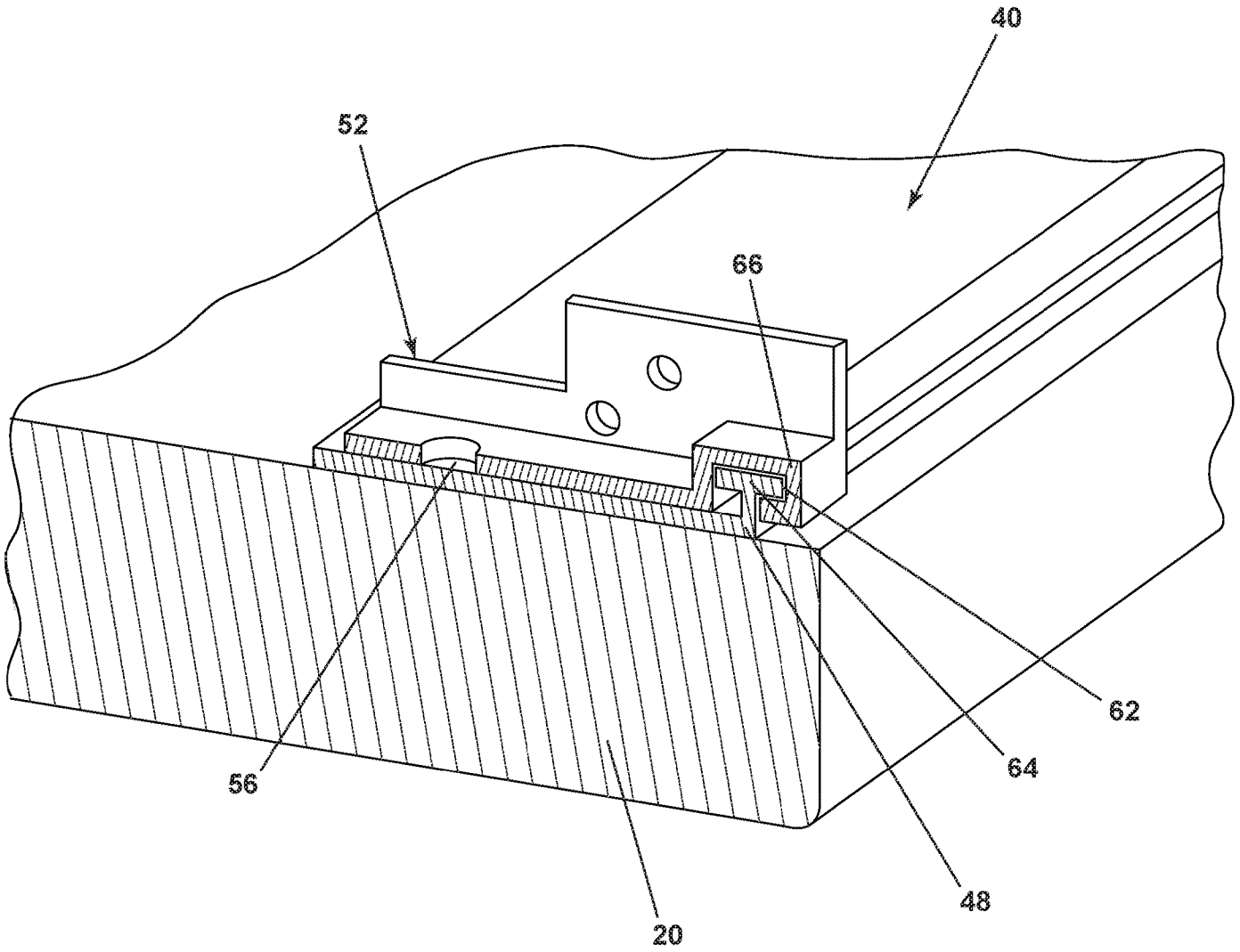
FIG. 4 is a cross-sectional view of a cabinet door, a brace, a rail, and a hinge plate of the hinge assembly of FIG. 3.

FIG. 4 is a cross section view of the cabinet door 20, the brace 40, the rail 48, and the first hinge plate 52 of the hinge assembly 32 taken along line IV-IV of FIG. 3.

The first hinge plate 52 includes at least a partial channel 62 in which a portion of the rail 48 is received. The partial channel 62 and the rail 48 have at least partially complementary cross sections. A non-limiting example of a slidable connection of the rail 48 and the first hinge plate 52 can include the rail 48 having a T-shaped cross section 64 and the at least a partial channel 62 having a J-shaped cross section 66. Alternatively, the rail 48 can have a Q-shaped cross section that is complimented by a C-shaped cross section of the first hinge plate 52. The first hinge plate 52 can be fixed to the brace 40 at the first fixing point 56.

Figure 5:
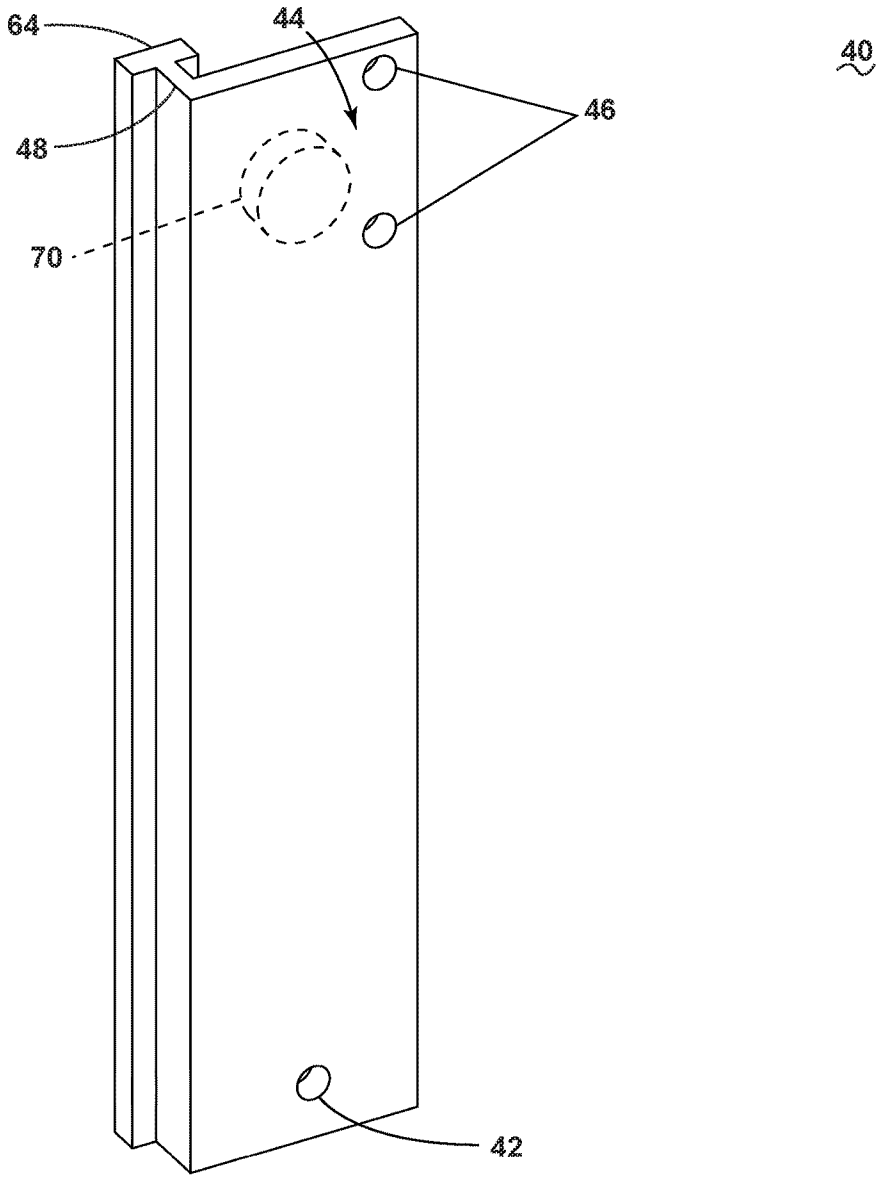
FIG. 5 is a back view of a portion of the hinge assembly of FIG. 3

FIG. 5 is a rear view of the brace 40. The second attachment point 44 of the brace 40 can include the first apertures 46 and an optional projection 70. The projection 70 can be received within hinge recess 26 illustrated in FIG. 1.

Figure 6:
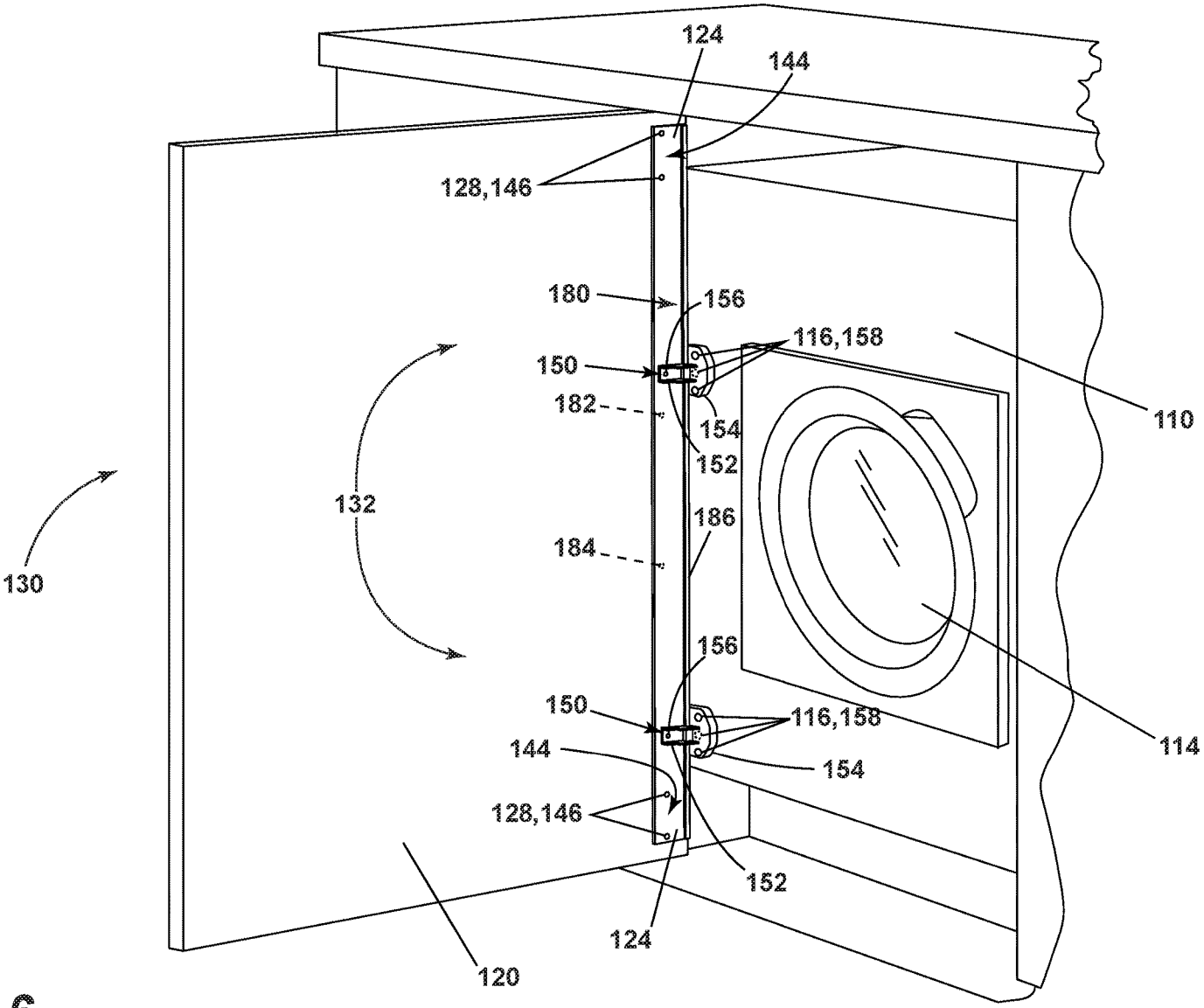
FIG. 6 a perspective view of the built-in household appliance and the surrounding cabinetry with a connecting assembly according to another aspect of the present disclosure.

FIG. 6 illustrates a hinge assembly 132 used to couple the cabinet door 120 to the household appliance 110. The hinge assembly 132 includes a brace 180 and one or more hinges 150. The hinge assembly 132 in combination with the cabinet door 120 forms a cabinet door assembly 130. Like parts will be identified with like numerals increased by 100 from FIG. 2, with it being understood that the description of the like parts remain the same unless otherwise noted.

The brace 180 can be secured to the cabinet door 120 at second attachment points 144. The second attachment points 144 include first apertures 146 that correspond to second apertures 128. The brace 180 can be elongated to extend along the cabinet door 120; spanning more than one second apertures 128 and more than one first hinge mounts 116.

The brace 180 can include additional fixing points that can be, but are not limited to, fixing points 182, 184. The brace 180 has a rail 186 on which one or more first hinge plates 152 are slidably mounted. The first hinge plates 162 can be fixably mounted to the single brace 190 at first fixing points 156.

Figure 7:
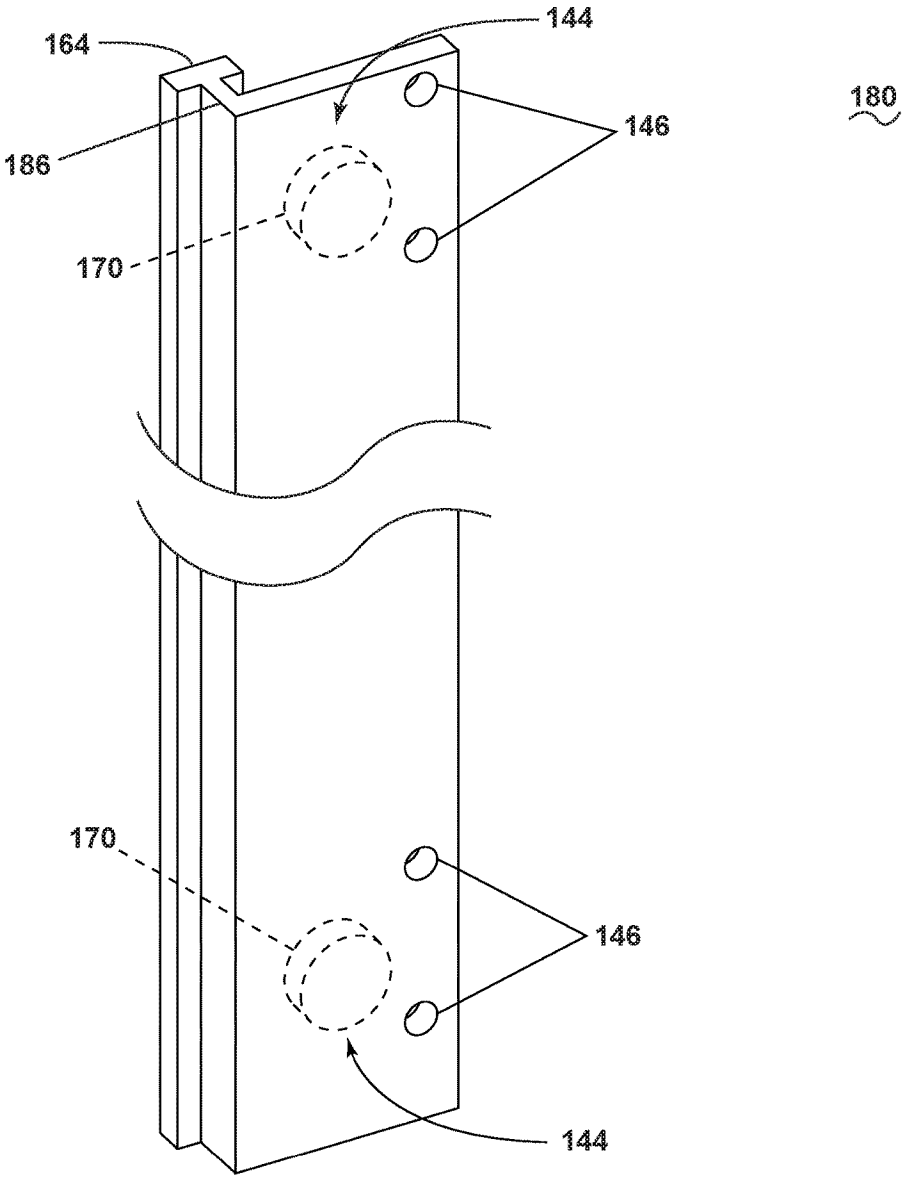
FIG. 7 is a back view of a portion of the connecting assembly of FIG. 6.

FIG. 7 is a rear view of the brace 180. The second attachment point 144 of the brace 180 can include the first apertures 146 and optional projections 170. The projections 170 can be received within the hinge recess 26 illustrated in FIG. 1.

Figure 8:
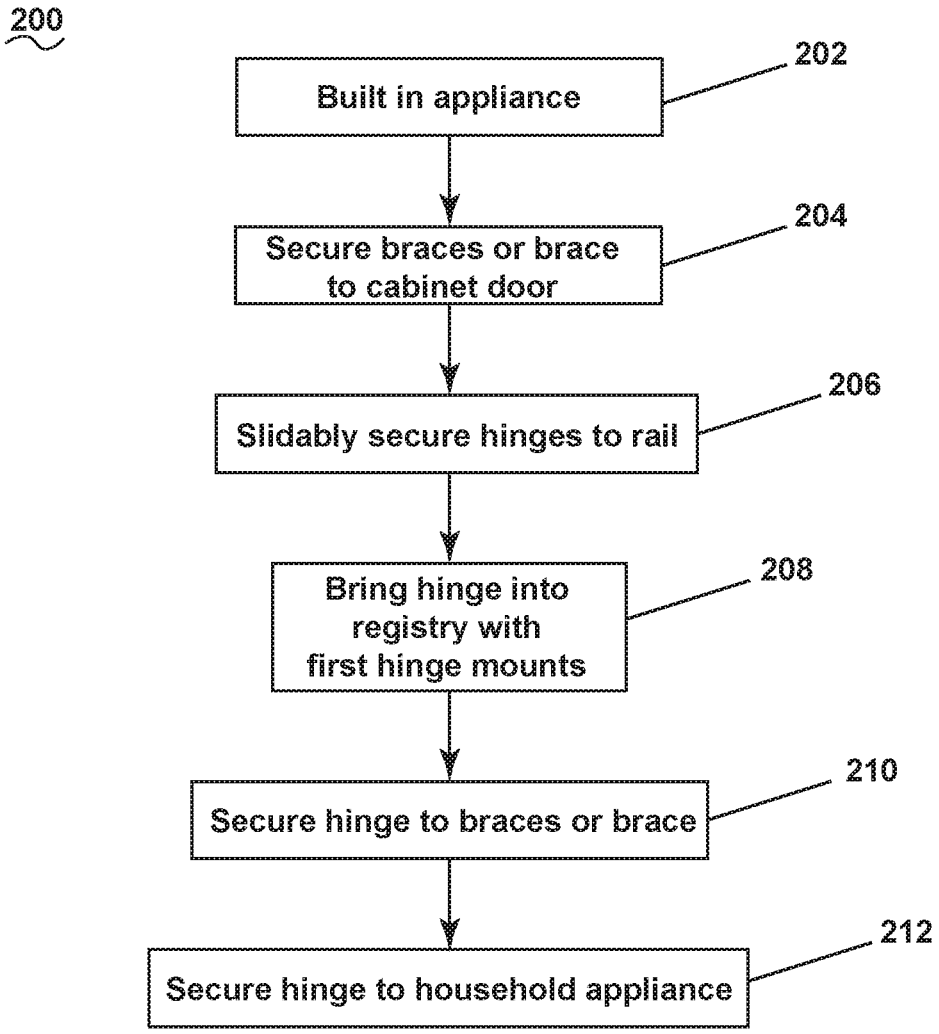
FIG. 8 is a flow chart illustrating a method to mount the cabinet door to the household appliance.

FIG. 8 illustrates a method 200 for mounting the hinge 50, 150 with first and second hinge plates 52, 54, 152, 154 to the household appliance 10, 100 with the first hinge mount 16, 116 to the cabinet door 20, 120 with the second hinge mount 24, 124 which is out of registry with the first hinge mount 16, 116.

In 202, the household appliance 10, 100 is built-in so that it requires the attachment of the cabinet door 20, 120 to the household appliance 10, 100. In 204, the braces 40 with rails 48 are secured to the cabinet door 20. The braces 40 to the cabinet door 20 using the first attachment points 42. Additionally the braces 40 are secured to the cabinet door 20 by the alignment and fastening of the first apertures 46 of the second attachment points 44 to the second apertures 28 of the second hinge mounts 24. Optionally, the projection 70 on the rear of the brace 40 can also align with the hinge recess 26.

Alternatively at 204, the brace 180 with rail 186 can be secured to the cabinet door 120. The single brace 180 is secured to the cabinet door 120 by the alignment and fastening of the first apertures 146 of the second attachment points 144 to the second apertures 128 of the second hinge mount 124. Optionally, the brace 180 can be further secured to the cabinet door 120 using the fixing points 182, 184 or the fitting of projections 170 into the hinge recesses 26.

In 206, the hinges 50 includes the first hinge plates 52 that can be slid onto the rail 48 or alternatively, the first hinge plates 152 can be slid onto the rail 186. Slidably securing the first hinge plates 52, 152 can include the receiving of the rails 48 or rail 186 into the partial channel 62 on the first hinge plates 52, 152.

In 208, the hinges 50, 150 are brought in registry with the first hinge mounts 16, 116.

Once in registry, in 210, the first hinge plates 52, 152 can be secured to the braces 40 or the brace 180 using the first fixing points 56, 156.

In 212, the hinges 50, 150 are coupled to the household appliance 10, 100. The coupling of the hinges 50, 150 to the household appliance 10, 100 is accomplished by the securing of the second hinge plates 54, 154 to the first hinge mounts 24, 124.

The securing of the second hinge plates 54, 154 to the first hinge mount 24, 124 can include passing a fastener through aligned apertures of the second hinge plates 54, 154 and the first hinge mount 24, 124. Optionally, the spacer 60 can be located between the second hinge plates 54, 154 and the first hinge mounts 24, 124.

The household appliance 10, 110 can be, but is not limited to, a washing machine, a dryer, a combo washer/dryer, a dishwasher, or a refrigerator.

While the invention has been specifically described in connection with certain specific embodiments thereof, it is to be understood that this is by way of illustration and not of limitation. For example, it is understood that any of the features disclosed herein can be provided alone or in combination with each other. Reasonable variation and modification are possible within the scope of the foregoing description and drawings without departing from the spirit of the invention which is defined in the appended claims.

The invention claimed is:

1. A cabinet door assembly for a household appliance having at least one predetermined first hinge mount, the cabinet door assembly comprising:

a cabinet door having at least one predetermined second hinge mount, which is out of alignment with the at least one predetermined first hinge mount;

a brace having a first attachment secured to the cabinet door at a first location other than the at least one predetermined second hinge mount, a second attachment secured to the cabinet door at the at least one predetermined second hinge mount, and a rail extending along the brace and having a predetermined cross section; and a hinge comprising:

a first hinge plate that includes a channel that receives a portion of the rail, wherein the channel and the rail have at least partially complementary cross sections to slidably secure the first hinge plate to the rail; and a second hinge plate rotatably coupled to the first hinge plate and securable to the at least one predetermined first hinge mount.

2. The cabinet door assembly of claim 1 wherein the brace is elongated and extends along the cabinet door from the at least one predetermined second hinge mount to below the at least one predetermined first hinge mount.

3. The cabinet door assembly of claim 1 wherein the second attachment has a first aperture that corresponds to a second aperture of the at least one predetermined second hinge mount.

4. The cabinet door assembly of claim 1 wherein the at least one predetermined second hinge mount has a hinge recess and the second attachment has a projection received within the hinge recess.

5. The cabinet door assembly of claim 1 wherein the at least one predetermined first hinge mount comprises a pair of vertically spaced first hinge mounts and the at least one predetermined second hinge mount comprises a pair of vertically spaced second hinge mounts.

6. The cabinet door assembly of claim 1 wherein the cabinet door is for a standard height cabinet.

7. The cabinet door assembly of claim 1 wherein the at least one predetermined first hinge mount that is out of alignment from the at least one predetermined second hinge mount is a vertical misalignment.

8. A hinge assembly for securing a first hinge mount of a household appliance to a second hinge mount of a cabinet door that is out of alignment with the first hinge mount, the hinge assembly comprising:

a brace having a first attachment secured to the cabinet door at a first location other than the second hinge mount, a second attachment secured to the cabinet door at the second hinge mount, and a rail extending along the brace and having a predetermined cross section; and a hinge comprising:

a first hinge plate with a channel that receives a portion of the rail, wherein the channel and the rail have at least partially complementary cross sections to slidably secure the first hinge plate to the rails; and a second hinge plate rotatably coupled to the first hinge plate and securable to the first hinge mount.

9. The hinge assembly of claim 8 wherein the first hinge mount comprises a pair of vertically spaced first hinge mounts and the second hinge mount comprises a pair of vertically spaced second hinge mounts.

10. The hinge assembly of claim 8 wherein the cabinet door is for a standard height cabinet.

11. The hinge assembly of claim 8 wherein the first hinge mount that is out of alignment from the second hinge mount is a misalignment.

12. The hinge assembly of claim 8 wherein the rail has a T-shaped cross section and the channel has a J-shaped cross section.

13. The hinge assembly of claim 8 further comprising a spacer between the second hinge plate and the first hinge mount.

14. A method of mounting a hinge with rotatable first and second hinge plates to a household appliance with a first hinge mount and to a cabinet door with a second hinge mount out of alignment with the first hinge mount, the method comprising:

securing a brace, the brace having a rail extending along the brace with a predetermined cross section, to the second hinge mount;

slidably moving the first hinge plate along a portion of the rail, wherein the rail is received by a channel on the first hinge plate, such that the second hinge plate is in alignment with the first hinge mount; and securing the second hinge plate to the first hinge mount.

15. The method of claim 14 wherein the securing the brace to the second hinge mount comprises inserting a projection on the brace into a recess of the second hinge mount.

16. The method of claim 14 wherein the securing the brace to the second hinge mount comprises passing a fastener through aligned apertures of the brace and the second hinge mount.

17. The method of claim 14 wherein securing the second hinge plate to the first hinge mount comprises passing a fastener through aligned apertures of the second hinge plate and the first hinge mount.

18. The method of claim 14 further comprising providing a spacer between the second hinge plate and the first hinge mount.

19. The method of claim 14 further comprising securing the first hinge plate to the rail when the second hinge plate is in alignment with the first hinge mount.

* * * * *